US011686456B2

(12) United States Patent
Kantak et al.

(10) Patent No.: US 11,686,456 B2
(45) Date of Patent: Jun. 27, 2023

(54) TILTING ORCHESTRAL LIGHT

(71) Applicant: Wenger Corporation, Owatonna, MN (US)

(72) Inventors: Jason G. Kantak, Baldwinsville, NY (US); James R. Crooks, Orono, MN (US); Tracy J. Steiger, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 94 days.

(21) Appl. No.: 16/654,355

(22) Filed: Oct. 16, 2019

(65) Prior Publication Data

US 2020/0116335 A1 Apr. 16, 2020

Related U.S. Application Data

(60) Provisional application No. 62/746,253, filed on Oct. 16, 2018.

(51) Int. Cl.

| | |
|---|---|
| ***F21V 17/02*** | (2006.01) |
| ***F21V 15/01*** | (2006.01) |
| ***F21V 17/12*** | (2006.01) |
| ***F21Y 115/10*** | (2016.01) |
| ***F21W 131/406*** | (2006.01) |

(52) U.S. Cl.

CPC ..... *F21V 17/02* (2013.01); *F21V 15/01* (2013.01); *F21V 17/12* (2013.01); *F21W 2131/406* (2013.01); *F21Y 2115/10* (2016.08)

(58) Field of Classification Search

CPC ..... F21V 21/30; F21V 21/04; F21V 14/02; F21V 17/162; F21V 21/34; F21V 17/02; F21V 15/01; F21V 17/12; F21Y 2107/20; F21Y 115/10; F21W 131/406

USPC ..... 362/364

See application file for complete search history.

(56) References Cited

U.S. PATENT DOCUMENTS

| | | | | |
|---|---|---|---|---|
| 8,777,459 | B2 * | 7/2014 | Patti | F21V 21/14 362/364 |
| 2010/0110698 | A1 * | 5/2010 | Harwood | F21V 21/30 362/365 |
| 2012/0243232 | A1 * | 9/2012 | Bertram | F21V 19/0035 362/249.02 |
| 2015/0219295 | A1 * | 8/2015 | Clark | F21V 21/042 362/396 |
| 2015/0345761 | A1 * | 12/2015 | Lawlor | F21V 21/14 362/364 |
| 2017/0268737 | A1 * | 9/2017 | Holscher | F21V 23/003 |
| 2018/0023790 | A1 * | 1/2018 | Johnson | F21V 31/005 362/427 |

* cited by examiner

*Primary Examiner* — William J Carter
(74) *Attorney, Agent, or Firm* — Patterson Thuente, P.A.

(57) ABSTRACT

An innovative light fixture for use with acoustical shells is disclosed. The fixture incorporates a dome gimbal to allow rotation front-to-back and left-right around a horizontal axis and a third axis of rotation around a vertical axis. The dome configuration allows for a low profile and toolless adjustment allows stage side aiming by hand.

22 Claims, 9 Drawing Sheets

TILTING ORCHESTRAL LIGHT

CROSS-REFERENCE TO RELATED APPLICATION

The present application claims the benefit of U.S. Provisional Application No. 62/746,253, filed Oct. 16, 2018, which is hereby incorporated herein in its entirety by reference.

TECHNICAL FIELD

The present invention relates to orchestral lights, specifically, the present invention relates to light fixtures used with acoustical shells.

BACKGROUND

The use of lighting for orchestras, including acoustical shells, is well known. Existing orchestra shell light fixtures are fixed (unable to pan or tilt) or have to be yoke mounted. Yoke mounted lights extends into the shell, which is aesthetically unappealing. Recessing light fixtures for acoustical shells addressed these issues, but were limited to fixed focus and had profiles that were so large as to interfere with other shell and stage equipment (e.g., wiring, controls, cables). Prior art light fixtures were not only limited in functionality, but also had drawbacks of generating heat, which made musicians performing in the shell uncomfortable, and generating noise from the lights and cooling fans.

While prior art devices have attempted to address the issue of lighting for acoustical shells, there exists a desire for an aesthetically pleasing and safe light fixture that allows full functionality, to allow line sets and other equipment to bypass the device without snagging on the fixture when it is in a stored position.

SUMMARY

The present invention is directed to a light fixture for use with acoustical shells. The fixture utilizes a snag-free dome gimbal to allow rotation front-to-back and left-right around a horizontal axis and a third axis of rotation around a vertical axis. The rotation of the fixture maintains the overall fixture location so that the LED light does not move closer or further away from the floor or subject of intended illumination. The dome design of the invention also minimizes the overall height of the fixture to allow line sets and other equipment to bypass the device without snagging on the fixture when it is in a stored position.

The fixture also incorporates a tool-less adjustment feature. The fixture has two adjustment knobs located on the stage side of the shell ceiling to allow free motion and aiming at a subject or area on a stage. Once the fixture is positioned to the proper aiming point, the user can tighten the knobs to lock the fixture in place. All adjustments are performed from below the fixture or what is referred to in the art as "stage side." The fixture adjustment aiming is hand-only, not requiring any tools.

The above summary is not intended to describe each illustrated embodiment or every implementation of the subject matter hereof. The figures and the detailed description that follow more particularly exemplify various embodiments.

ADVANTAGES OF THE INVENTION

Allows for panning and tilting of light without having to be yoke mounted.

Allows for adjustment in three dimensions . . . pan, tilt and rotate.

Adjustments can be made to the positioning of the light without tools.

The design of the disclosed light is c is inherently safer than prior art lights.

All parts and accessories are bolted in unit to prevent individual parts from separating once mounted.

Compact design eliminates interference with other equipment used with or near the acoustical shell to which the fixtures are used.

BRIEF DESCRIPTION OF THE DRAWINGS

Subject matter hereof may be more completely understood in consideration of the following detailed description of various embodiments in connection with the accompanying figures, in which.

Figure 1:
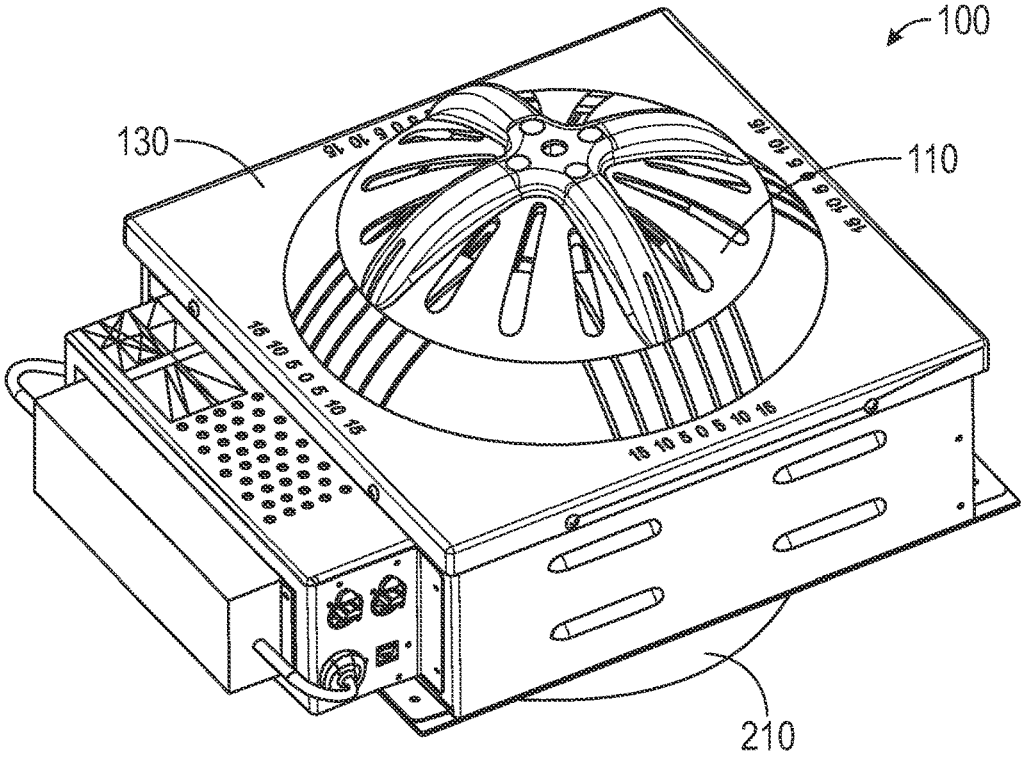
FIG. 1 is a top perspective view of a tilting orchestral light according to an embodiment of the invention.
Figure 2:
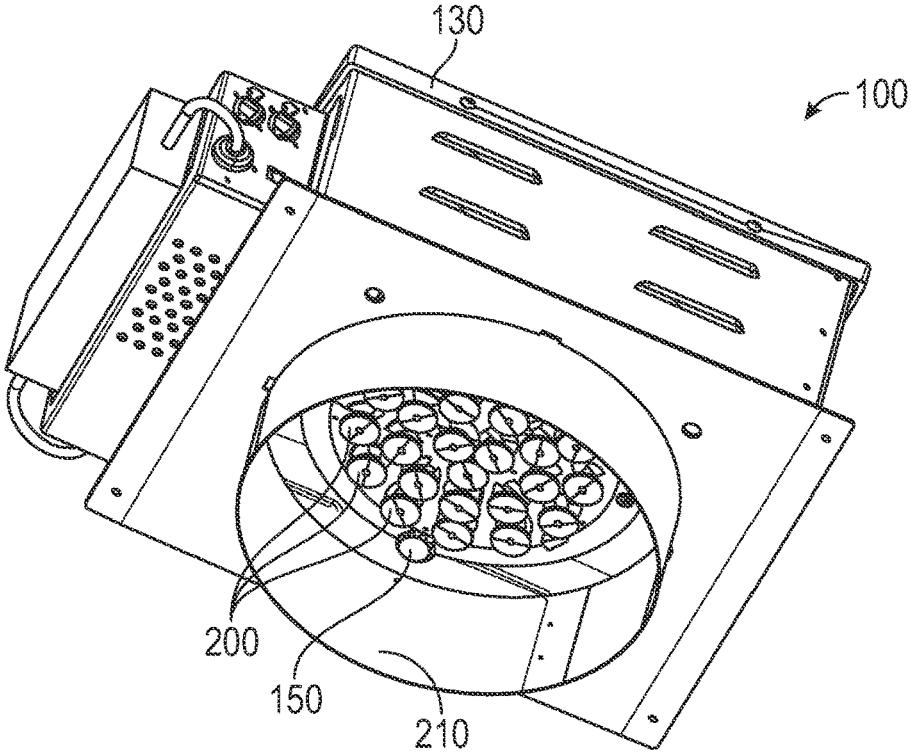
FIG. 2 is a bottom perspective view of the tilting orchestral light of FIG. 1.
Figure 3:
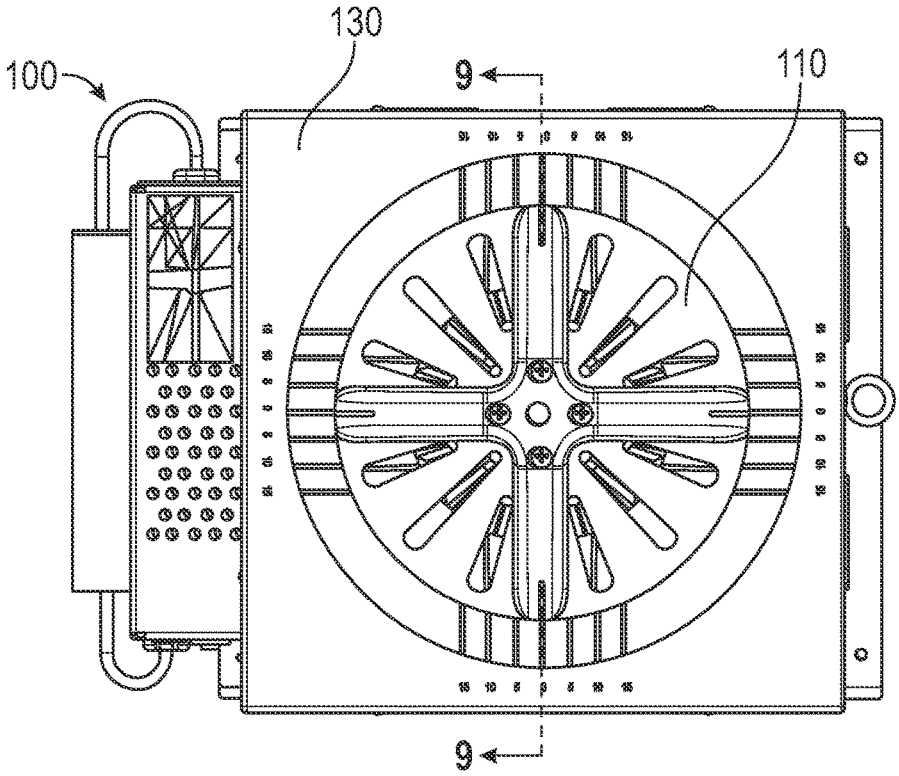
FIG. 3 is a top view of the tilting orchestral light of FIG. 1.
Figure 4:
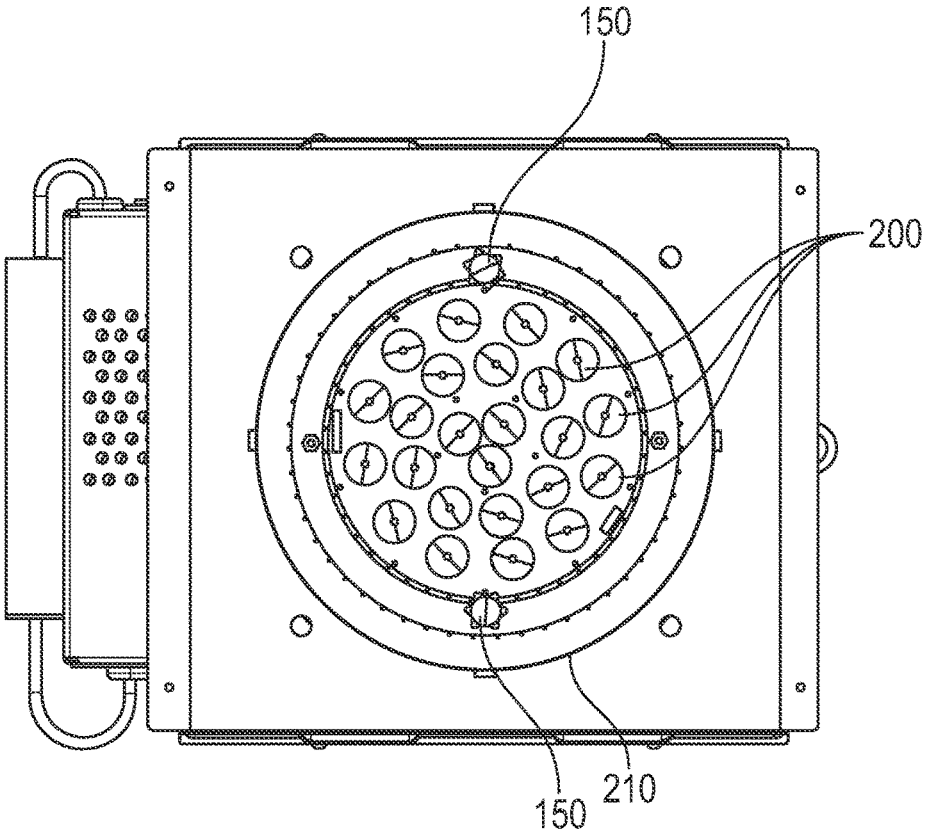
FIG. 4 is a bottom view of the tilting orchestral light of FIG. 1.
Figure 5:
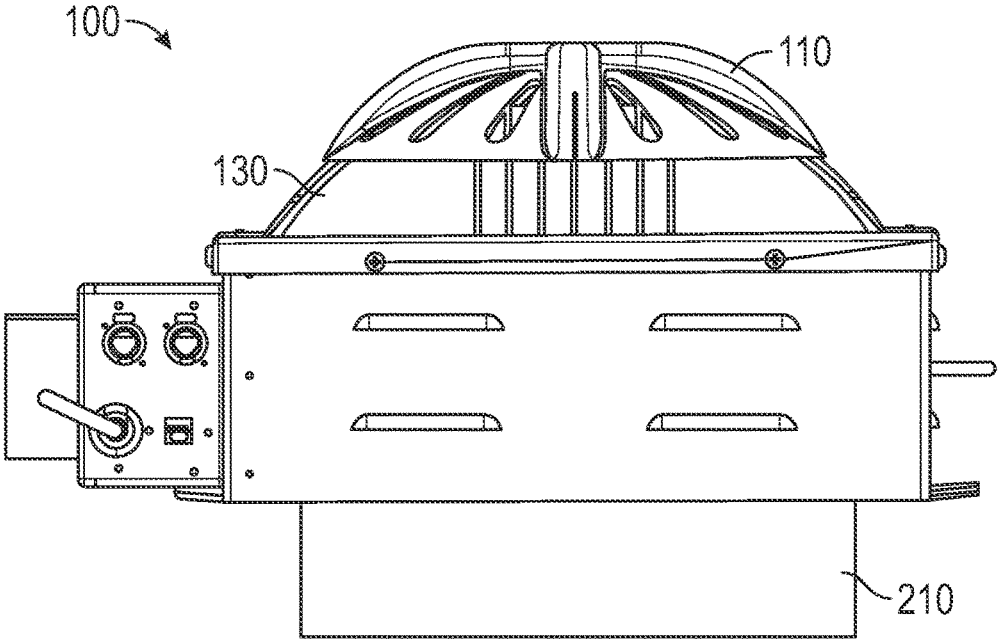
FIG. 5 is a front elevation view of the tilting orchestral light of FIG. 1.
Figure 6:
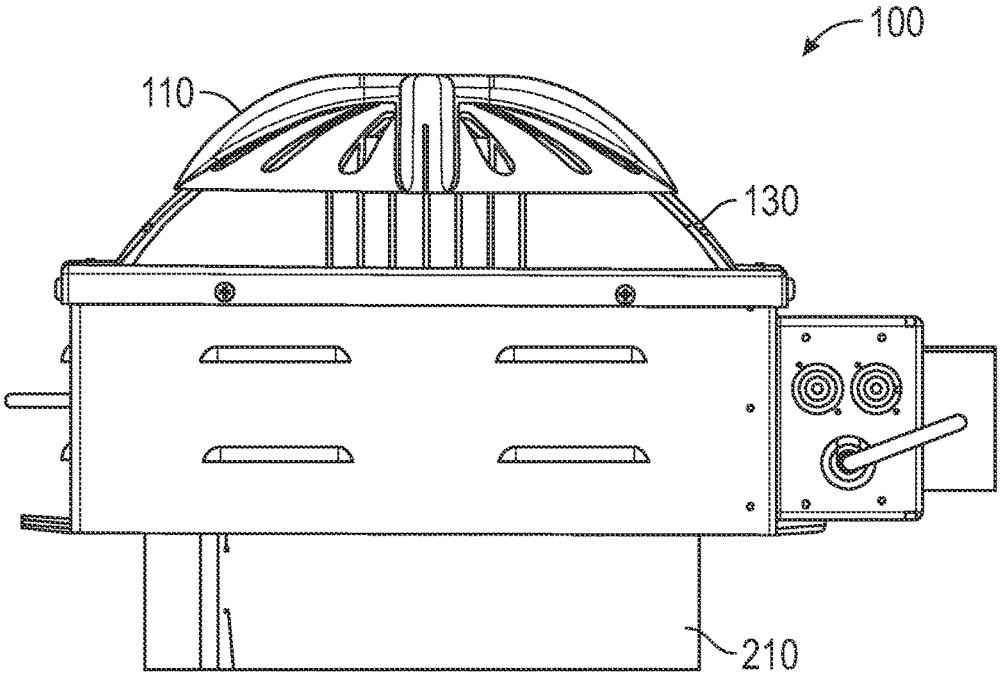
FIG. 6 is a rear elevation view of the tilting orchestral light of FIG. 1.
Figure 7:
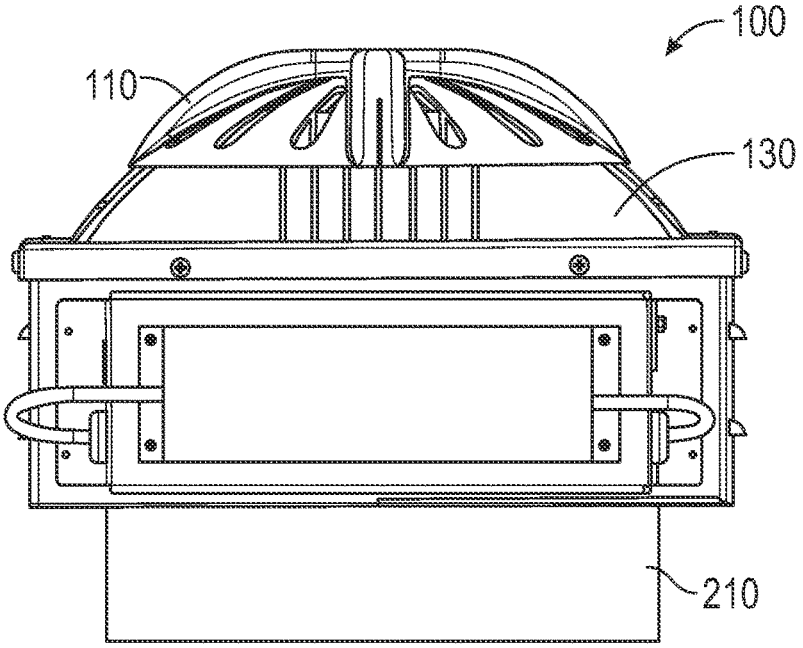
FIG. 7 is a left elevation view of the tilting orchestral light of FIG. 1.
Figure 8:
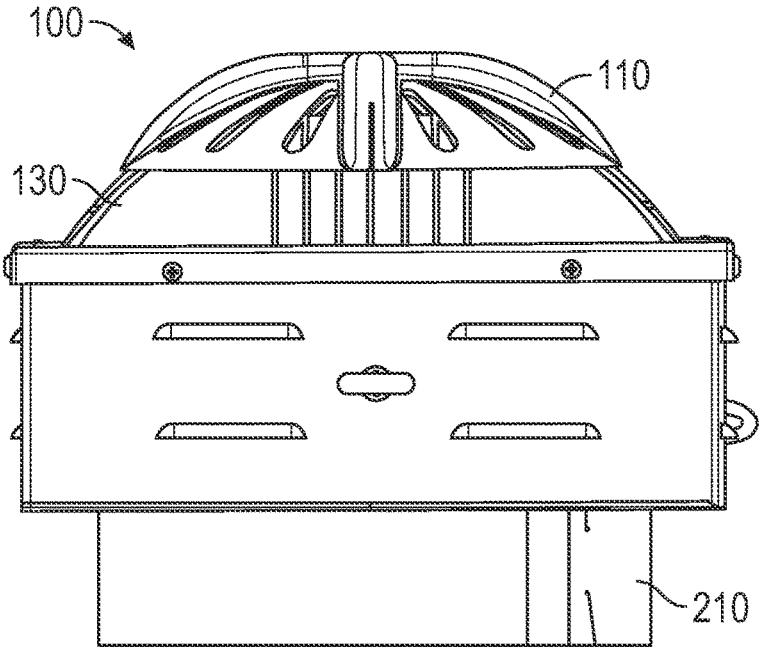
FIG. 8 is a right elevation view of the tilting orchestral light of FIG. 1.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 9:
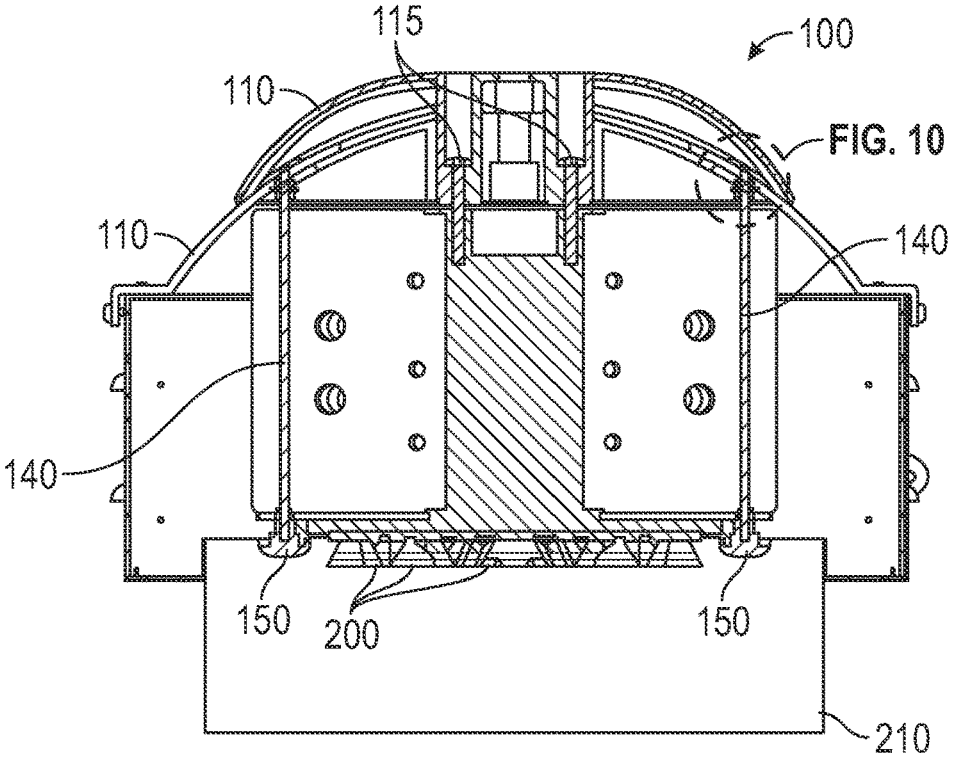
FIG. 9 is a cross-sectional view of the tilting orchestral light of FIG. 3 taken along line A-A.

A light fixture according to an embodiment of the invention is depicted generally in FIGS. 1-8 with reference numeral 100. In the embodiment depicted in FIGS. 1-8, the light fixture 100 comprises a light box cover 130 and a top slide cover 110. FIG. 9 presents a cross-sectional view of the same embodiment of FIGS. 1-8. As illustrated in FIG. 9, the embodiment depicted in FIGS. 1-8 further includes a slide block 120.

Figure 12:
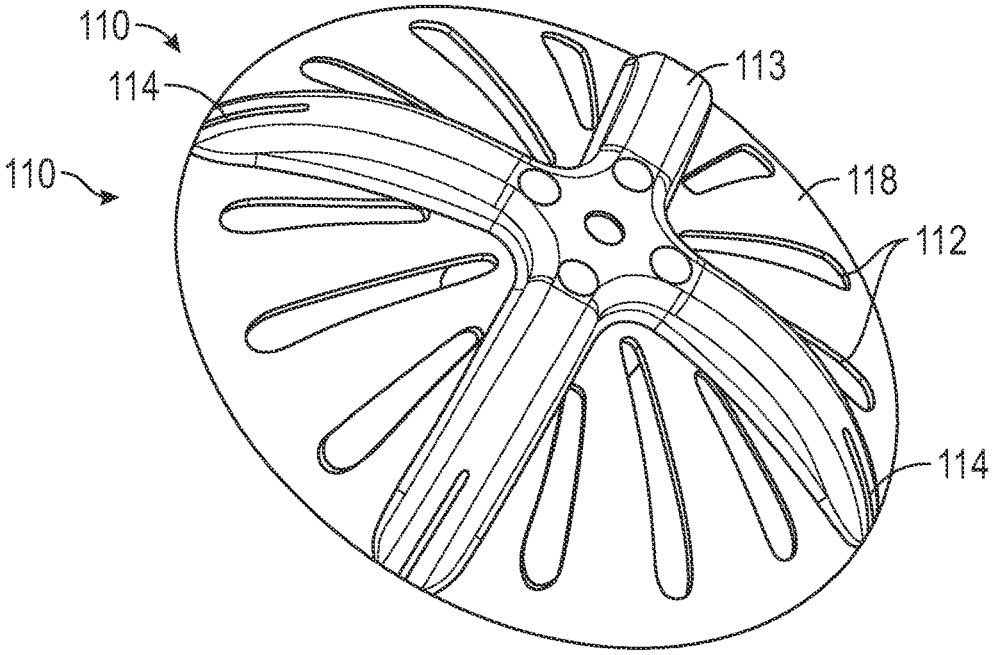
FIG. 12 is a top perspective view of the top slide cover of the tilting orchestral light of FIG. 1.
Figure 13:
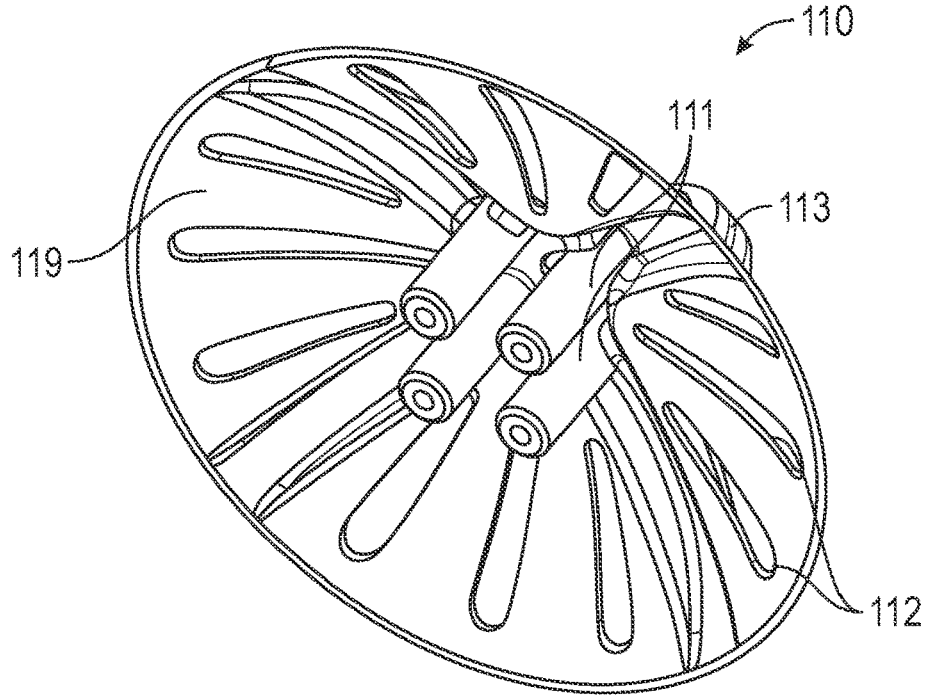
FIG. 13 is a bottom perspective view of the top slide cover of the tilting orchestral light of FIG. 1.
Figure 14:
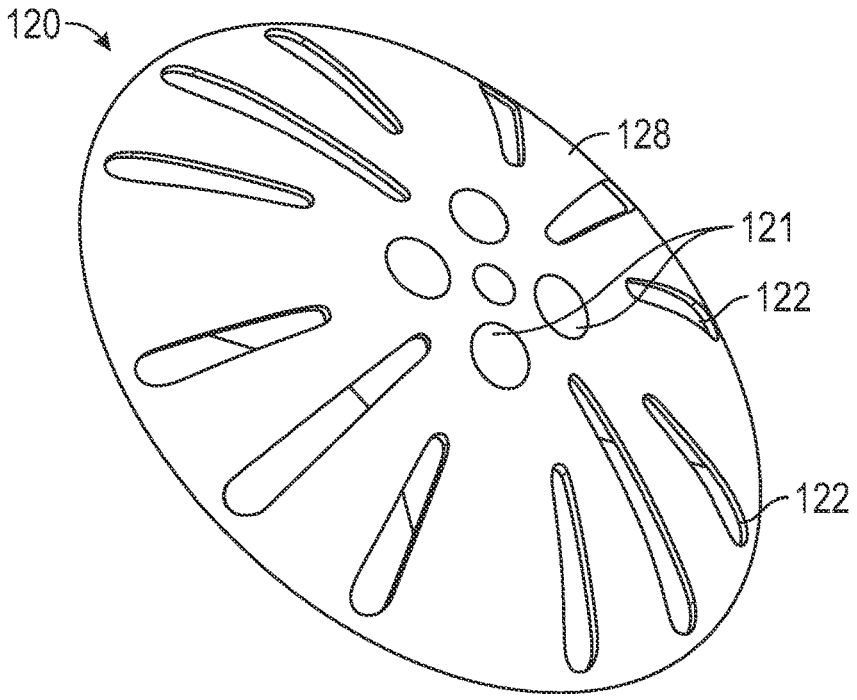
FIG. 14 is a top perspective view of the slide block of the tilting orchestral light of FIG.
Figure 15:
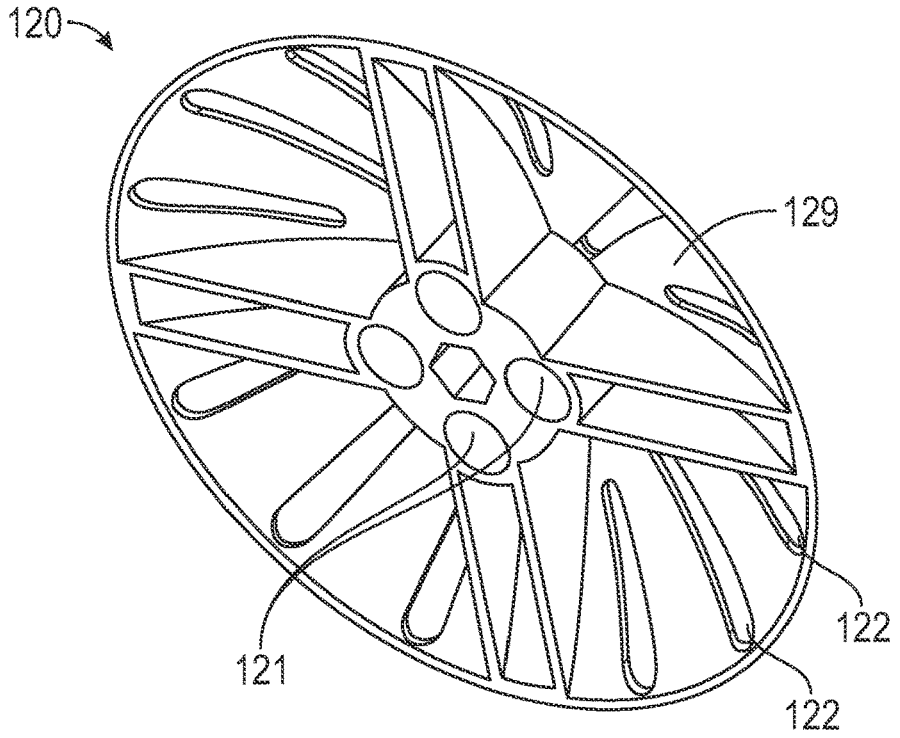
FIG. 15 is a bottom perspective view of the slide block of the tilting orchestral light of FIG. 1.

As shown in FIGS. 12-13, the top slide cover 110 has an interior surface 118 and an exterior surface 119, and includes extensions 111, vent slots 112, and spines 113. FIGS. 14-15 illustrate a slide block 120 with an interior surface 128, exterior surface 129, extension apertures 121, and vent slots 122. The slide block extension apertures 121 are sized to accommodate the top slide cover extensions 111 while allowing movement between the top slide cover 110 and slide block 120. Both the top slide cover 110 and slide block 120 include vent slots 112, 122 to allow heat to dissipate from the light fixture 100. The top slide cover 110 may also include spines 113 that function to both add strength to the top slide cover 110 and to function as a handle to facilitate adjustment of the light fixture 100. The spines 113 may include markings 114 for use in aligning top slide cover 110 to light box cover 130 for specific aiming of the device.

Figure 16:
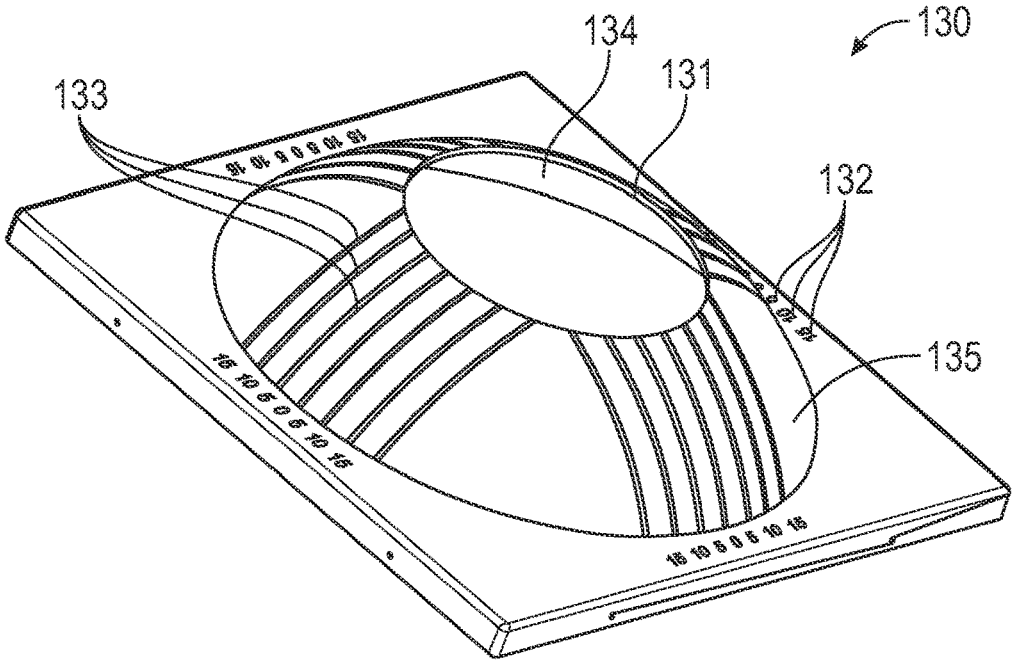
FIG. 16 is a top perspective view of the light box cover of the tilting orchestral light of FIG. 1.
Figure 17:
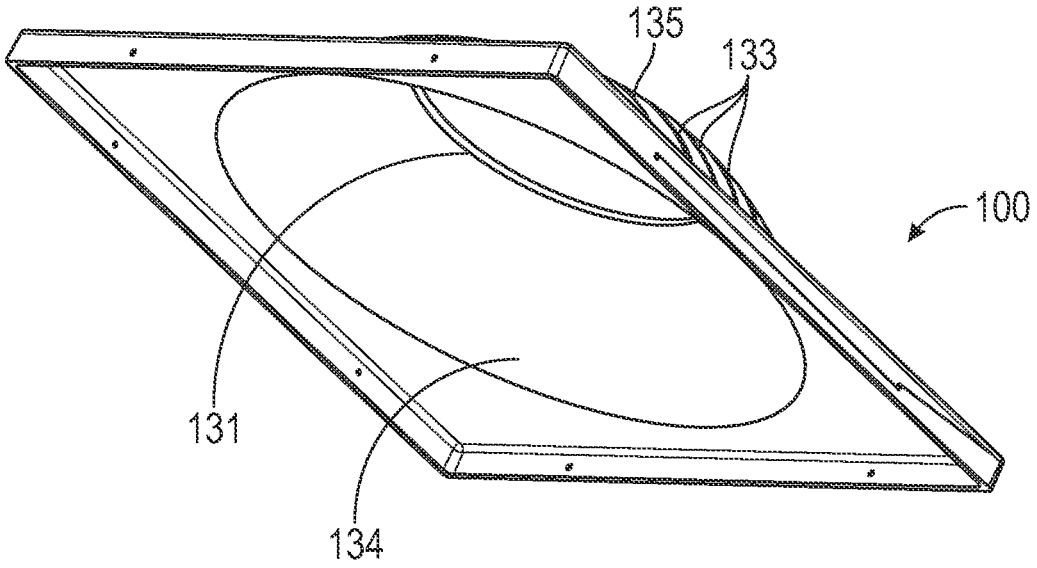
FIG. 17 is a bottom perspective view of the light box cover of the tilting orchestral light of FIG. 1.

FIGS. 16-17 present top and bottom perspective views of the light box cover 130 with an interior surface 134 and exterior surface 135. Light box cover 130 includes an inside edge 131 that rests between the top slide cover 110 and slide block 120 (see FIG. 9). The light box cover 130 may have numeric indicators 132 and adjustment markings 133 to align the top slide cover 110 to the light box cover 130.

As best seen in FIG. 9, the light box cover 130 is sandwiched between the slide block 120 and top slide cover 110 wherein at least a part of the slide block 120 contacts the interior surface 134 of the light box cover 130 and at least part of the top slide cover 110 contacts the exterior surface 135 of the light box cover 130.

In the embodiment depicted in FIGS. 1-17, the light fixture 100 includes at least one LED light 200 illuminating toward the bottom of the light fixture 100 (i.e., away from the light box cover 130). The LED lights 200 are understood to be stage-facing. The preferred embodiment of light fixture 100 includes an array of LED lights 200 to provide flexible, adjustable lighting options as well as a bezel 210 for controlling the spread of light from the light fixture 100.

Figure 10:
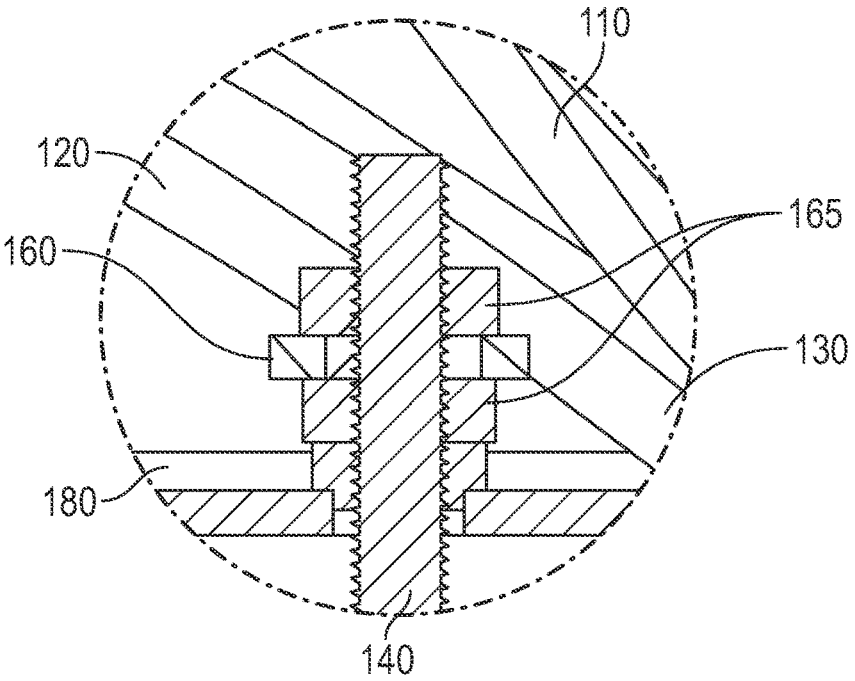
FIG. 10 is a detail view of the tilting orchestral light of FIG. 9 taken at arc B-B.
Figure 11:
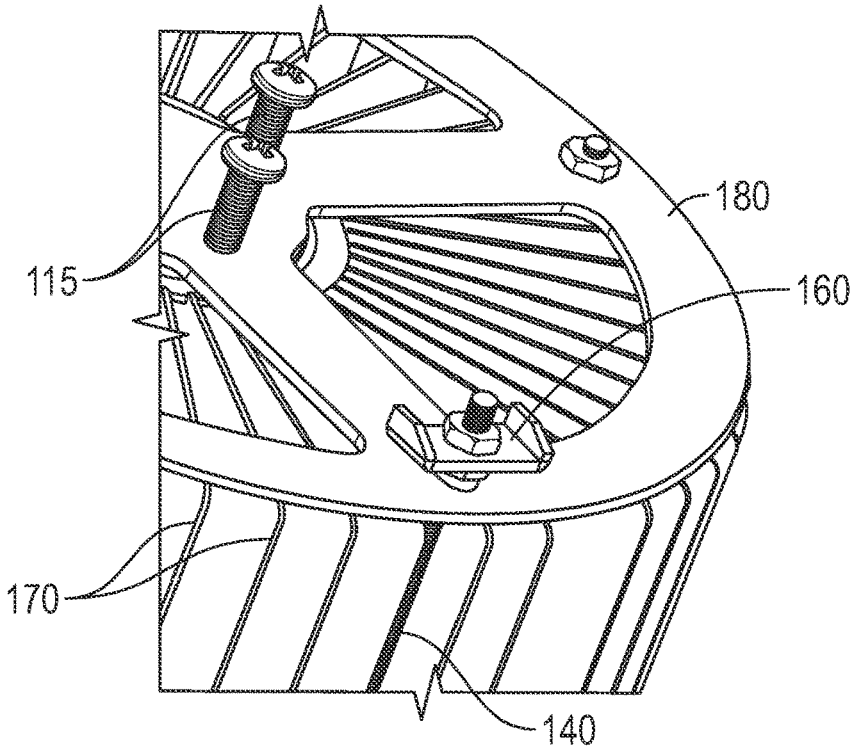
FIG. 11 is a close-up perspective of the detail view of FIG. 10.

Adjustment of the light fixture 110 may be explained via FIGS. 9-11. As previously disclosed, the light box cover 130 is sandwiched between the slide block 120 on its interior surface 134 and the top slide cover 110 on its exterior surface 135. The extensions 111 of the top slide cover 110 are sized to fit within the extension apertures 121 of the slide block 120, but with enough play to allow movement between the top slide cover 110 and slide block 120. In one embodiment, the top slide cover is attached to the light fixture 100 by bolts 115 inserted through the extensions 111.

Adjustment in the position (aiming) of the light box cover 130 is controlled by friction on the light box cover 130 caused by the slide block 120 and the top slide cover 110. In the embodiment shown in FIGS. 1-17, the friction is regulated by pressing a lock bracket 160 against the interior surface 128 of the slide block 120. The lock bracket 160 is preferably shaped to conform to the interior surface 128 of the slide block 120 to facilitate contact between the parts and increase friction when the lock bracket 160 is moved toward the slide block 120. Friction is decreased by moving the lock bracket 160 away from the slide block 120.

In a preferred embodiment, movement of the lock bracket 160 is accomplished via turning of a threaded rod 140, to which the lock bracket 160. In the depicted embodiment, the threaded rod 140 is threaded through a fin frame 180 of the light fixture 100, which causes the threaded rod 140 as well as the lock bracket 160 to move up (toward the slide block 120) or down (away from the slide block 120). For comfort and to facilitate adjustment of the light fixture 100 from its stage side, the threaded rod 140 runs the depth of the light fixture 100 to the bottom surface and includes a knob 150. This arrangement allows for adjustment of the light fixture 100 without the need for tools. The preferred embodiment includes two lock brackets 160 to ensure the light fixture 100 maintains its set adjustment.

In one embodiment, the lock bracket 160 is attached to the threaded rod 140 by lock bracket nuts 165. The threaded rod 140 moves up and down while rotating through a threaded fixture 185 in the fin frame 180. The threaded rod 140 may be threaded along its entire length or may be threaded only along the portion necessary to traverse the threaded fixture 185. This arrangement allows all parts of the light fixture 100 to remain together, preventing loose parts from falling during or after adjustment.

The disclosed configuration of the light fixture 100 not only allows front-to-back and left-to-right movement, but the gimbal design also allows rotation of the LED light engine around a vertical axis. Additionally, the dome design of the top of the light fixture 100 minimizes the overall height of the fixture to allow line sets and other equipment to pass by the light fixtures 100 without snagging.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. An acoustical shell light fixture adapted to receive an LED light, comprising:

a light fixture cover;

a top slide cover in contact with an exterior surface of the light box cover, the top slide cover having a plurality of extensions coupled to an interior surface of the top slide cover;

a slide block in contact with an interior surface of the light box cover, the slide block defining a plurality of extensions apertures configured to receive the plurality of extensions, the slide block being rotatably coupled to the top slide cover via a variable fastener extending through the acoustical shell light fixture;

a lock bracket configured to move upwards or downwards with the variable fastener; and an adjustment mechanism operably coupled to the variable fastener and positioned to face a bottom surface when the acoustical shell light fixture is attached to a top surface, wherein the light box cover is interposed between the top slide cover and the slide block, and wherein the adjustment mechanism is configured to enable the top slide cover, the slide block, and the lock bracket to function as a three-axis gimbal, thus enabling rotation and tilt about a vertical axis and horizontal movement between the top slide cover and the slide block via the plurality of extensions and the plurality of extension apertures.

2. The acoustical shell light fixture of claim 1 wherein the lock bracket is movable from a locked position where the lock bracket compresses the light box cover between the slide block and top slide cover to prevent movement of the light box cover and an unlocked position where the lock bracket allows movement of the light box cover.

3. The acoustical shell light fixture of claim 2 wherein the variable fastener is a threaded rod attached to the light box cover and to the lock bracket, wherein rotating the threaded rod in a direction moves the lock bracket to a locked position and wherein rotating the threaded rod in an opposite direction moves the lock bracket to an unlocked position.

4. The acoustical shell light fixture of claim 3 wherein the adjustment mechanism is a knob positioned distal to the lock bracket.

5. The acoustical shell light fixture of claim 1 wherein the variable fastener is a threaded rod attached to the light box cover, wherein rotating the threaded rod in a direction compresses the slide block against the light box cover and wherein rotating the threaded rod in an opposite direction releases compression between the slide block and the light box cover.

6. The acoustical shell light fixture of claim 5 wherein the adjustment mechanism is a knob positioned distal to the light box cover.

7. The acoustical shell light fixture of claim 6 wherein the slide block comprises vent slots.

8. The acoustical shell light fixture of claim 6 wherein the top slide cover comprises vent slots.

9. The acoustical shell light fixture of claim 8 wherein the top slide cover comprises a spine.

10. The acoustical shell light fixture of claim 6 wherein the light box cover comprises numeric indicators.

11. A light fixture adapted to receive an LED light array comprising:

a top slide cover having an interior surface;

a slide block having an exterior surface, the slide block rotatably coupled to the top slide cover via a variable fastener extending through the light fixture;

a light fixture cover interposed between the top slide cover interior surface and the slide block exterior surface;

a lock bracket configured to move upwards or downwards with the variable fastener; and an adjustment mechanism operably coupled to the variable fastener and positioned to face a bottom surface when the acoustical shell light fixture is attached to a top surface, wherein the top slide cover, slide block, and lock bracket function as a three-axis gimbal enabling rotation and tilt about a vertical axis and horizontal movement between the top slide cover and the slide block.

12. The light fixture of claim 11 wherein the lock bracket is movable from a locked position where the lock bracket compresses light box cover between the slide block and top slide cover and an unlocked position where the lock bracket does not compress the light box cover between the slide block and the top slide cover.

13. The light fixture of claim 11 wherein the variable fastener is a threaded rod attached to the lock bracket, wherein rotating the threaded rod in a direction moves the lock bracket to a locked position and wherein rotating the threaded rod in an opposite direction moves the lock bracket to an unlocked position.

14. The light fixture of claim 13 wherein the adjustment mechanism is a knob positioned distal to the lock bracket.

15. The light fixture of claim 11 wherein the variable fastener is a threaded rod attached to the light box cover, wherein rotating the threaded rod in a direction compresses the slide block against the light box cover and wherein rotating the threaded rod in an opposite direction releases compression between the slide block and the light box cover.

16. The light fixture of claim 15 wherein the adjustment mechanism is a knob positioned distal to the light box cover.

17. The light fixture of claim 16 wherein the light box cover comprises numeric indicators.

18. A light fixture adapted to receive an LED light comprising:

a top slide cover;

a slide block; and a light box cover interposed between the top slide cover and the slide block; and a threaded rod attached to the light box cover;

wherein rotating the threaded rod in a direction compresses the light box cover between the slide block and top slide cover to prevent movement of the light box cover and rotating the threaded rod in an opposite direction releases compression on the light box cover between the slide block and the light box cover;

wherein the top slide cover, slide block, and threaded rod function as a three-axis gimbal enabling rotation and tilt about a vertical axis and horizontal movement between the top slide cover and the slide block; and wherein the top slide cover is not fixedly joined to the slide block.

19. The light fixture of claim 18 further comprising a knob on the threaded rod, distal to the top slide cover.

20. The light fixture of claim 19 wherein the slide block comprises vent slots and the top slide cover comprises vent slots.

21. The light fixture of claim 19 further comprising a lock bracket wherein the lock bracket is movable from a locked position where the lock bracket compresses the light box cover between the slide block and top slide cover to prevent movement of the light box cover and an unlocked position where the lock bracket allows movement of the light box cover.

22. The light fixture of claim 19 wherein the light box cover comprises numeric indicators.

* * * * *